US011739946B2

(12) United States Patent
Nakagawa et al.

(10) Patent No.: US 11,739,946 B2
(45) Date of Patent: Aug. 29, 2023

(54) COOKING APPARATUS

(71) Applicant: Samsung Electronics Co., Ltd., Suwon-si (KR)

(72) Inventors: Suguru Nakagawa, Yokohama (JP); Keita Mori, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 325 days.

(21) Appl. No.: 17/126,542

(22) Filed: Dec. 18, 2020

(65) Prior Publication Data

US 2021/0199307 A1 Jul. 1, 2021

(30) Foreign Application Priority Data

Dec. 25, 2019 (JP) ..... 2019-234823
Jul. 15, 2020 (JP) ..... 2020-121658
Nov. 10, 2020 (KR) ..... 10-2020-0149467

(51) Int. Cl.
*F24C 15/20* (2006.01)

(52) U.S. Cl.
CPC ..... *F24C 15/20* (2013.01); *F24C 15/2028* (2013.01)

(58) Field of Classification Search
CPC ..... F24C 15/20; F24C 15/2028
See application file for complete search history.

(56) References Cited

U.S. PATENT DOCUMENTS

2007/0158328 A1 7/2007 Kim et al.
2013/0125764 A1 5/2013 Jeong et al.
2013/0248150 A1 9/2013 Ninagawa et al.
2017/0067645 A1 3/2017 Jeong et al.
2018/0310761 A1* 11/2018 Morello ..... A47J 37/0786

FOREIGN PATENT DOCUMENTS

JP 5646776 B1 12/2014
JP 2019-007715 A 1/2019
KR 10-0737831 B1 7/2007
WO 2019/053793 A1 3/2019

OTHER PUBLICATIONS

International Search Report dated Mar. 5, 2021, issued in International Application No. PCT/KR2020/018758.

* cited by examiner

*Primary Examiner* — Alfred Basichas
(74) *Attorney, Agent, or Firm* — Jefferson IP Law, LLP

(57) ABSTRACT

A cooking apparatus is provided. The cooking apparatus includes a body, a heating part disposed on an upper surface of the body and configured to heat an object to be heated, and an outlet part arranged on opposite sides of the heating part and configured to allow air to be discharged to an upper side of the body. The outlet part includes an outlet to which air is discharged, and a louver arranged on the outlet and configured to guide an airflow discharged from the outlet part to allow the airflow discharged from the outlet part to mix with an airflow generated by the heating part, thereby forming an ascending airflow directed from a front side to a rear side of the body.

17 Claims, 14 Drawing Sheets

COOKING APPARATUS

CROSS-REFERENCE TO RELATED APPLICATION(S)

This application is based on and claims priority under 35 U.S.C. § 119(a) of a Japanese patent applications number 2019-234823, filed on Dec. 25, 2019, in the Japan Patent Office, of a Japanese patent application number 2020-121658, filed on Jul. 15, 2020, in the Japan Patent Office, and of a Korean patent application number 10-2020-0149467, filed on Nov. 10, 2020, in the Korean Intellectual Property Office, the disclosure of each of which is incorporated by reference herein in its entirety.

BACKGROUND

1. Field

The disclosure relates to a built-in heating cooker. More particularly, a cooker capable of guiding smoke to a ventilation device during cooking without increasing noise and vibration of the ventilation device and without causing an increase in cost and size of the cooker.

2. Description of Related Art

Smoke generated in a built-in heating cooker during cooking is guided to a ventilation device installed above the built-in heating cooker. For example, as for an electronic heating cooker, an up-flow velocity of heated air containing smoke may be lower and the smoke may spread without reaching a collection range of the ventilation device in comparison with a gas heating cooker. It is possible to increase the collection range by increasing an output of the ventilation device, but it may cause other difficulty, such as an increase in the noise and vibration of the ventilation device.

Japanese unexamined patent application publication No. 2019-007715 discloses a configuration in that an outlet is provided on an upper surface of a heating cooker and smoke is guided to a ventilation device by an airflow discharged from the outlet. In a case in which the outlet is installed on a front portion (a side in which a cook is placed) of the upper surface, the airflow may spread out due to interference with the cook and an object to be heated. Therefore, the outlet may be installed on a rear portion of the upper surface.

However, even if the outlet is provided on the rear portion of the upper surface, it is required to generate a large air volume or high velocity of airflow by using a large fan so that the airflow generated in the rear side guides smoke generated in the front portion of the upper surface. Therefore, it may cause the increase in the cost and size of the cooker.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide a cooker capable of guiding smoke to a ventilation device during cooking without increasing noise and vibration of the ventilation device and without causing an increase in cost and size of the cooker.

Additional aspects will be set forth in part in the description which follows and, in part, will be apparent from the description, or may be learned by practice of the presented embodiments.

In accordance with an aspect of the disclosure, a built-in heating cooker is provided. The built-in heating cooker includes a range body including a heating part, which is configured to heat an object to be heated and to which the object to be heated is mounted, provided on an upper surface. An outlet is formed on left and right sides of the heating part on the upper surface. An airflow discharged from the outlet is directed from a front side to a rear side.

Because the outlet is formed on the left and right sides of the heating part on which the object to be heated is mounted and further the airflow discharged from the outlet is directed from the front side to the rear side, it may be possible to effectively guide smoke to a ventilation device during cooking.

Therefore, it may be possible to guide smoke to the ventilation device during cooking without increasing noise and vibration of the ventilation device and without causing an increase in cost and size of the cooker.

As a specific embodiment to allow the airflow discharged from the outlet to be directed from the front side to the rear side, it may further includes a blowing mean configured to generate an airflow discharged from the outlet, and a louver provided in the outlet to allow a direction of the airflow discharged from the outlet to be from the front side to the rear side.

However, in the configuration in which the outlet is provided, foreign substances, such as spills caused that an object to be cooked overflows may fall from the outlet.

Therefore, it may be appropriate that a debris tank provided below the outlet and configured to receive foreign substances falling from the outlet is further provided.

In this configuration, foreign substances falling from the outlet may be stored in the debris tank and thus it may be possible to prevent the foreign substances from being introduced into a flow path connected to the outlet.

It may be appropriate that a nozzle member configured to communicate with a slit formed on a side wall of the debris tank and including an inner space serving as a part of a flow path of airflow directed to the outlet is further provided.

In this configuration, because the nozzle member communicates with the slit formed on the side wall of the debris tank and the object falling from the outlet falls down directly by gravity, it may be possible to prevent the foreign substance from being introduced into the nozzle member.

It may be appropriate that the silt and a discharge port of the nozzle member in a downstream side are arranged to face each other and a lower side portion of the discharge port is located below a lower side portion of the slit.

In this configuration, the air discharged from the nozzle member may be smoothly delivered to the louver.

It may be appropriate that the lower side portion of the discharge port includes a protrusion in contact with the side wall by protruding toward the side wall of the debris tank.

In this configuration, because, a gap between the side wall of the debris tank and the nozzle member is sealed by the protrusion, it may be possible to prevent the foreign substances from being introduced through the gap.

It may be appropriate that a region of an inner surface of the nozzle member facing the slit is curved to be close to the slit as the region goes upward, and a lower end of the louver is located on a virtual extension line Lx formed by extending an edge portion, which is on the most downstream side of the curved region, toward a tangential direction, or the lower end of the louver is located above the virtual extension line.

In this configuration, it may be possible to smoothly deliver air discharged from the nozzle member to the louver, and thus it may be possible to effectively guide smoke to the ventilation device during cooking.

It may be appropriate that the outlet is formed in a rod shape extending from the front to the rear of the upper surface, the debris tank is formed in a rod shape extending from the front to the rear of the outlet, and a longitudinal length of the debris tank is greater than a longitudinal length of the outlet.

In this configuration, the debris tank may secure a large volume and thus even if a large amount of the cooking object overflows, the overflowing object corresponding to foreign substances may be reliably stored in the debris tank.

In response to a position of the outlet being on a lower side of the upper surface, foreign substances caused by overflowing may easily flow into the outlet, but in response to a position of the outlet being on an upper side of the upper surface, the outlet may cause inconvenience during cooking.

In order to prevent the foreign substance from being introduced into the outlet and to prevent the inconvenience during cooking, it may be appropriate that the outlet is provided on the same surface as the upper surface.

As a more specific embodiment of the disclosure, the outlet may be formed and a lid member configured to cover the debris tank may be further provided, and an upper surface of the lid member may be provided on the same surface as the upper surface.

It may be appropriate that the lid member is non-magnetic.

In this case, the lid member is not affected by heat of an induction heating (IH) range.

It may be appropriate that the debris tank is detachable upward from the upper surface.

In this configuration, it is not required to move the heating cooker or it is not required for a user to take an uncomfortable position for separating the debris tank. Accordingly, it may be possible to easily remove the foreign substance collected in the debris tank or to wash the debris tank, thereby achieving ease of maintenance.

It may be appropriate that a water level sensor provided in the debris tank is further provided.

In this configuration, it may be possible to prevent the foreign substances, which flows into the debris tank, from being pouring out from the debris tank.

When the inlet of the ventilation device is provided above the range body, the outlet is formed in the rod shape extending from the front to the rear of the upper surface, a front flow path configured to communicate with a front portion of the outlet is provided, a rear flow path configured to communicate with a rear portion of the outlet is provided, an angle formed by a vertical direction and a flow path direction of the front flow path is $\theta 1$, a distance along the front and rear direction from a front end of the outlet to a front end of the inlet is X, and a height along the vertical direction from the outlet to the inlet is Y, it may be appropriate to satisfy $\theta 1 \geq \tan^{-1}(X/Y)$.

In this configuration, smoke generated in the front portion of the range body may be more reliably guided to the ventilation device.

As a more specific embodiment of the disclosure, it may be appropriate that an airflow discharged from the front flow path is more inclined than an airflow discharged from the rear flow path with respect to the front and rear direction.

In this configuration, because smoke generated in the font portion of the range body is reliably guided to the ventilation device and at the same time, the airflow discharged from the rear flow path is more vertically upward than the airflow discharged from the front flow path, it may be possible to form an appropriate airflow toward the ventilation device without guiding the smoke to the rear side, more than necessary. Therefore, it may be possible to improve the smoke collection efficiency.

However, for example, a built-in type heating cooker used in North America, or the like. includes an oven provided below the range body. In this configuration, a space for arranging the fan (a blowing means) configured to generate an airflow from the outlet may be limited.

Therefore, as for the configuration, in which the over provided below the range body is further provided, it may be appropriate that the blowing means corresponding to the outlet is respectively provided on left and right sides of the oven.

In this configuration, because the blowing means is provided in correspondence with each of the outlets, each blowing means may be a small fan, and thus the blowing means may be arranged in a limited space on both sides of the oven.

It may be appropriate that a duct member, which is provided in such a way that the blowing means is arranged in an upstream end thereof and a downstream end thereof communicates with the outlet corresponding to the blowing means, is further provided.

In this configuration, the airflow generated by the blowing means may be efficiently discharged from the outlet, and even if the blowing means is small, the smoke may be effectively guided to the ventilation device.

It may be appropriate that a guide portion configured to reduce a deflection of the airflow is provided at one or more positions in the duct member.

In this configuration, it may be possible to suppress the flow separation in the duct member and to achieve equalization of the airflow distribution. Therefore, it may be possible to more effectively generate the airflow for guiding the smoke to the ventilation device.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, like reference numerals will be understood to refer to like parts, components, and structures.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an" and "the" include plural referents unless the context clearly indicates otherwise. Thus, for example, reference to "a component surface" includes reference to one or more of such surfaces.

In this disclosure, the terms "including", "having", and the like are used to specify features, numbers, operations, elements, components, or combinations thereof, but do not preclude the presence or addition of one or more of the features, elements, operations, elements, components, or combinations thereof.

In addition, the meaning of "identical" in the disclosure includes a thing having similar properties or similar within a certain range. In addition, "identical" represents "substantially identical". It should be understood that a value, which corresponds to a value within a manufacturing error range or a value having a difference in a range invalid with respect to a reference value, is included in a range of "identical".

Hereinafter a built-in heating cooker according to a first embodiment of the disclosure will be described with reference to the drawings.

A built-in heating cooker (hereinafter, also referred to as a heating cooker) according to the embodiment is a heating device that is built in a kitchen to heat an object to be heated, and uses electricity, gaseous fuel, liquid fuel, or solid fuel as a heat source. Hereinafter as an example, a so-called electric cooker using electricity, which has a low up-flow velocity of heated air during heating in comparison with other heat sources, will be described as an example.

Figure 1:
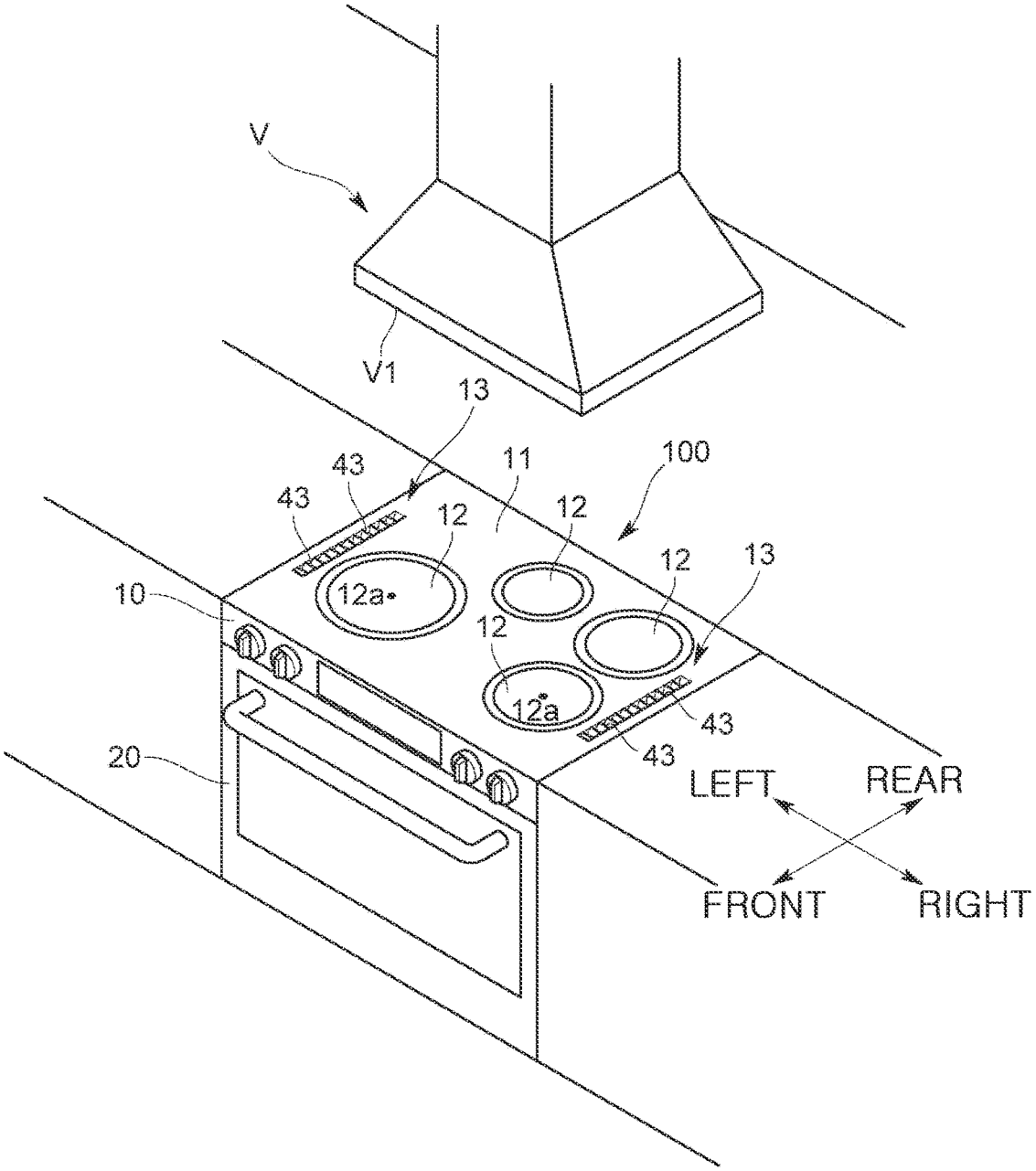
FIG. 1 is a schematic view illustrating an overall configuration of a built-in heating cooker according to a first embodiment of the disclosure.

FIG. 1 is a schematic view illustrating an overall configuration of a built-in heating cooker according to an embodiment of the disclosure.

Referring to FIG. 1, a heating cooker 100 includes a range body 10 on which an object to be heated, such as a pot or frying pan that accommodates food ingredients is mounted, and a ventilation device V configured to suck smoke during cooking is provided above the range body 10.

The range body 10 is configured to heat the mounted object to be heated, and includes one or more heating parts 12 provided on an upper surface 10 and on which the object to be heated is mounted. The heating part 12 employs an induction heating heater, but may employ a radiant heater.

Figure 2:
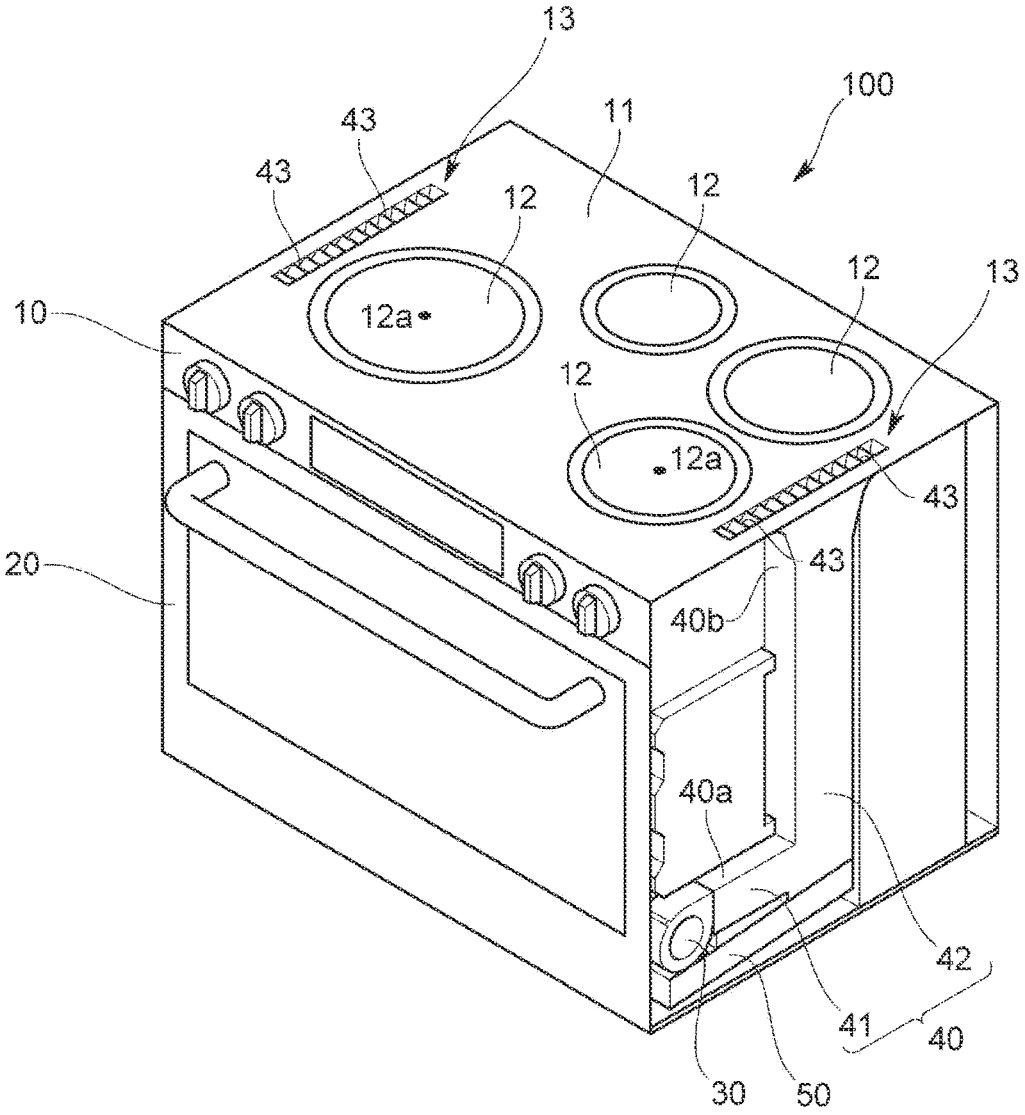
FIG. 2 is a schematic view illustrating an internal configuration of a built-in heating cooker according to the first embodiment of the disclosure.

FIG. 2 is a schematic view illustrating an internal configuration of a built-in heating cooker according to an embodiment of the disclosure.

Referring to FIGS. 1 and 2, the heating cooker 100 according to the embodiment further includes a range 20 provided below the range body 10, and the range 20 is formed integrally with the range body 10. In this case, a width of an inner space of the range 20 is set to be less than a width of the range body 10.

An outlet 13 is provided on left and right sides of the heating part 12 on the upper surface 11 of the above-described range body 10, and smoke or steam generated during cooking is guided to an inlet V1 of the ventilation device V by an airflow discharged from the outlet 13.

The left and right direction represents a left and right direction when viewed from a side of a user of the heating cooker 100, in other words, the left and right direction is a width direction of the range body 10.

More particularly, the upper surface 11 of the range body 10 has a substantially rectangular shape when viewed from above, and the outlet 13 is provided along both left and right sides (left side and right side) thereof. Accordingly, one or more heating parts 12 are positioned between the pair of outlets 13 on the upper surface 11 of the range body 10.

In addition, in order to guide smoke generated from the front portion of the upper surface 11 to the ventilation device V, a front end of the outlet 13 is positioned in front of a center 12*a* of at least one of heating part 12*a*. It is appropriate that the front end of the outlet 13 is positioned in front of a center 12*a* of the most front heating part 12*a*.

Figure 3:
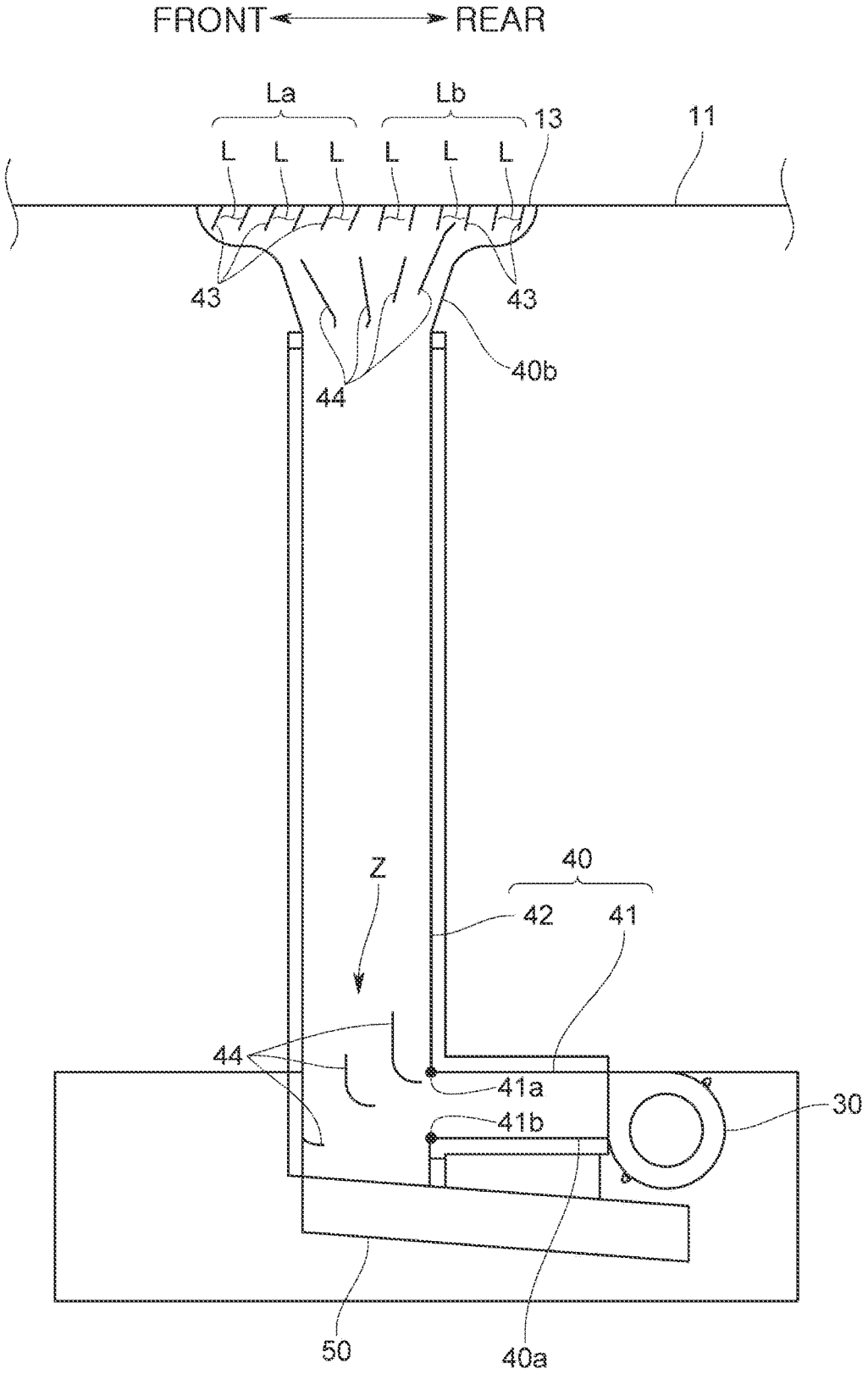
FIG. 3 is a schematic view illustrating an internal configuration of a built-in heating cooker according to the first embodiment of the disclosure.
Figure 4:
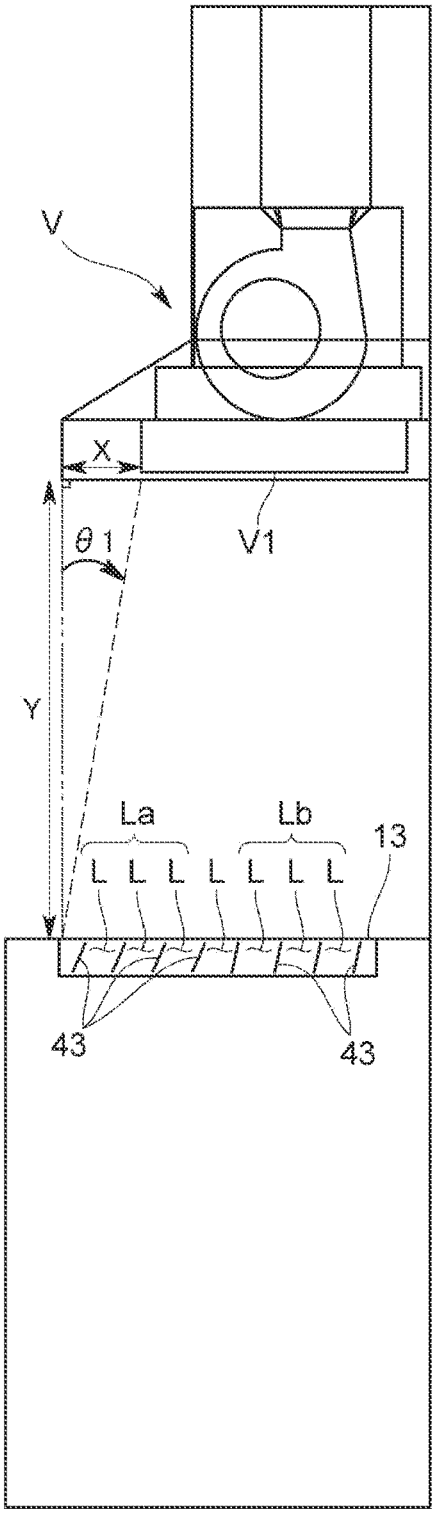
FIG. 4 is a schematic view illustrating a positional relationship between a front flow path and an inlet of a ventilation device according to the first embodiment of the disclosure.

Therefore, the heating cooker 100 according to the embodiment is configured to allow an airflow, which is discharged from the outlet 13, to flow from the front to the rear, as shown in FIGS. 3 and 4.

FIG. 3 is a schematic view illustrating an internal configuration of a built-in heating cooker according to an embodiment of the disclosure.

FIG. 4 is a schematic view illustrating a positional relationship between a front flow path and an inlet of a ventilation device according to an embodiment of the disclosure.

The front side is a direction from a side on which the heating cooker 100 is placed (a wall surface facing a user) to a side on which the user is placed, and the rear side is a direction from a side on which the user is placed to a side on which the heating cooker 100 is placed (the wall surface facing a user). In other words, a front and rear direction represents a depth direction of the range body 10.

Referring to FIG. 3, the heating cooker 100 according to the embodiment further includes a fan 30, which is a blowing means corresponding to each of the pair of outlets 13, and a duct member 40 configured to guide the airflow generated by the fan 30 to the inlet V1 corresponding to the fan 30.

The fan 30 is a blowing means configured to generate airflow to be discharged from the outlet 13, and the fan 30 may include a sirocco fan, a turbo fan, a propeller fan, or a cross-flow fan. The fan 30 is respectively provided on the left and right sides of the above-described oven, and more particularly, is disposed below an inner space of the oven.

Referring to FIGS. 2 and 3, the duct member 40 is provided in such a way that an upstream end 40*a* is connected to the outlet of the fan 30 and at the same time, a downstream end 40*b* communicates with the outlet 13 corresponding to the corresponding fan 30, and an inner space of the duct member 40 servers as a flow path of the airflow generated by the fan 30.

According to the embodiment of the disclosure, the duct member 40 has an approximately L-shape as shown in FIGS. 2 and 3, and the duct member 40 includes a sub-flow path member 41 extending rearward from the upstream end 40*a*, and a main flow path member 42 to which the sub-flow path member 41 is connected, thereby extending toward the downstream end 40*b*. Accordingly, the airflow generated by the fan 30 may be discharged rearward and then raised toward the outlet 13.

Referring to FIG. 3, a plurality of louvers 43 is embedded along the front and rear direction in the downstream end 40*b* of this duct member 40, and the downstream end 40*b* of the duct member 40 braches off a plurality of branched flow paths L by the plurality of louver 43. Accordingly, a flow path direction of the branched flow path L becomes a direction along the plurality of louver 43.

In addition, the plurality of louvers 43 is inclined in such a way that an upper end portion thereof is located rearward than a lower end portion thereof, and thus, the flow path direction of the plurality of branched flow paths L is inclined from the front to the rear. As a result, the generated airflow is discharged from the outlet 13 in the front and rear direction through the branched flow path L.

The outlet 13 according to the embodiment has a long rod shape extending along the front and rear direction (the depth direction) of the upper surface 11 as shown in FIG. 3, and the branched flow path L is of the outlet 13 is roughly divided into a front flow path La configured to communicate with a front portion of the outlet 13 and a rear flow path Lb configured to communicate with a rear portion of the outlet 13.

In this configuration, as shown in FIG. 4, a relationship among an angle θ1, which is formed by a vertical direction and a flow path direction of the front flow path La, a distance X along the front and rear direction from a front end of the outlet 13 to a front end of the inlet V1 of the ventilation device V, and a height Y along the vertical direction from the outlet 13 to the inlet V1 are set to satisfy $\theta 1 \geq \tan^{-1}(X/Y)$.

In addition, according to an embodiment of the disclosure, the heating cooker 100 is configured to allow an airflow discharged from the front flow path La to be more inclined than an airflow discharged from the rear flow path Lb with respect to the front and rear direction.

Figure 5:
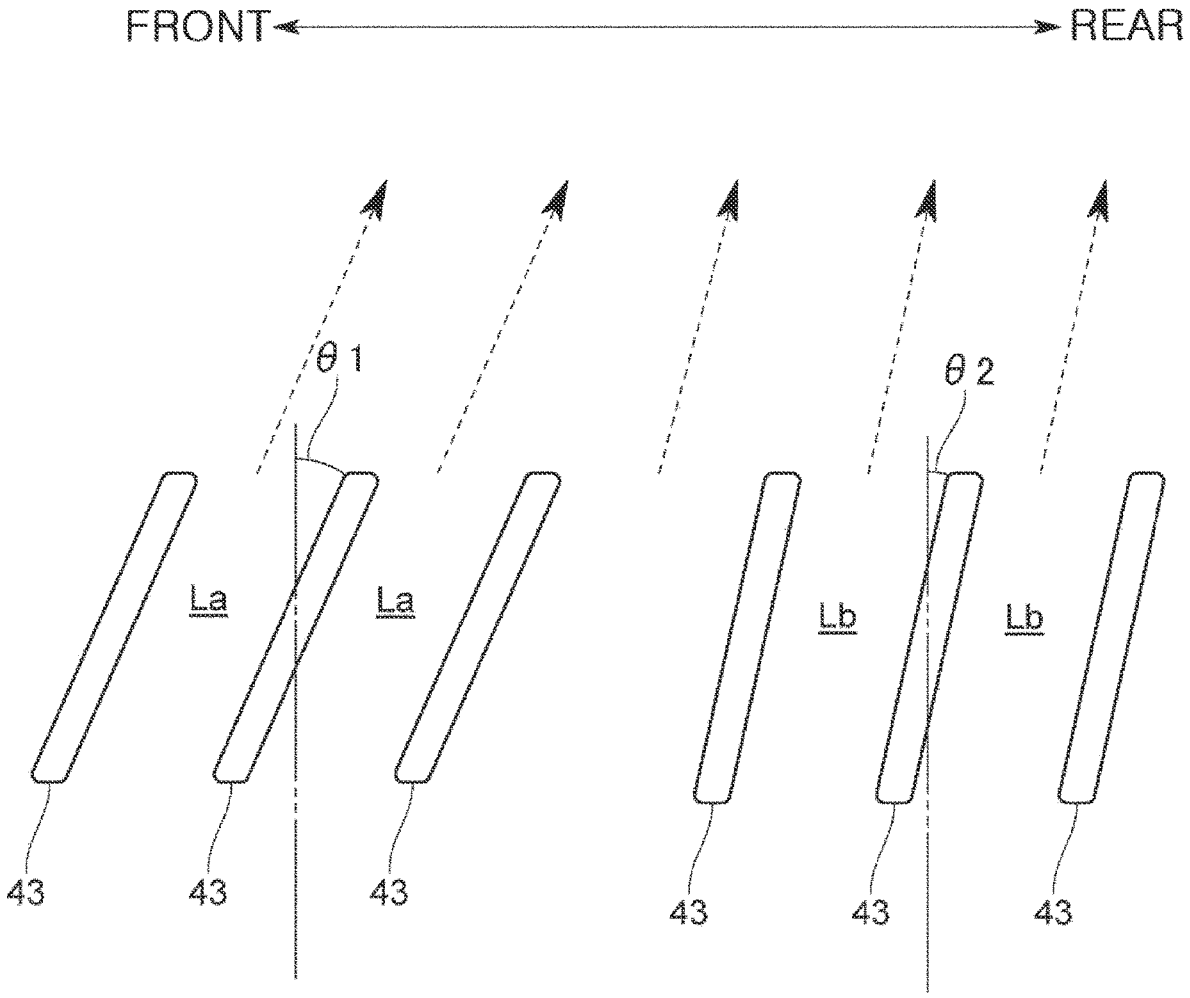
FIG. 5 is a schematic view illustrating an inclination of a front flow path and an inclination of a rear flow path according to the first embodiment of the disclosure.

FIG. 5 is a schematic view illustrating an inclination of a front flow path and an inclination of a rear flow path according to an embodiment of the disclosure.

Referring to FIG. 5, a relationship between the angle θ1 formed by the vertical direction and the flow path direction of the front flow path La and an angle θ2 formed between the vertical direction and the flow path direction of the rear flow path Lb is set to satisfy $\theta 1 > \theta 2$. The direction of the flow path of the rear flow path Lb may be the vertical direction (that is, angle $\theta 2 = 0°$), and may be a direction from the rear to the front.

Referring to FIG. 3, a guide 44 configured to reduce a deflection of an airflow is installed at one or more positions in the inside of the duct member 40.

The guide 44 is provided at a deflected portion of the airflow flowing through the inside of the duct member 40, and particularly, in the duct member 40, the guide 44 is provided in a bent portion Z in which the airflow directed backward from the fan 30 is bent upward, and provided in the downstream end 40*b* in which the airflow is expanded to a longitudinal direction of the outlet 13 and branches off the plurality of branched flow path L. The bent portion Z is a confluence through which the airflow, which flows through the sub flow path member 41, flows into the main flow path member 42.

At least two guides 44 are provided at each of the bent portion Z and the downstream end 40*b*, and it is more appropriate to provide three or four guides 44 to the bent portion Z and the downstream end 40*b*, respectively.

For example, the guides 44 provided in the bent portion Z are arranged at regular intervals in a horizontal direction (the front and rear direction), and at the same time, in a height direction, the guides 44 are arranged at intervals, which are to meet an airflow distribution, to allow an air volume between the guides 44 to be the same. For example, a particular shape of the guide 44 may have a curved shape, such as a partial arc shape (a shape obtained by dividing a circle into 4 to 8).

On the other hand, the guides 44 provided at the downstream end 40*b* are arranged to allow the airflow distribution in the plurality of branched flow path L to be the same that is the guides 44 are arranged to allow the airflow flowing each branched flow path L to be the same. For example, a particular shape of the guide 44 may have a flat plate shape, such as a whole flat plate or a flat plate on which a middle portion thereof is curved. In order to prevent the flow separation on a negative pressure surface of the guide 44, a separation preventing portion (not shown) shorter than the guide 44 may be arranged to cross in the height direction of the guide 44.

The arrangement, shape, number, or the like, of the guides 44 at the bent portion Z and the downstream end 40*b* are not limited to the above-described embodiments, and may vary. Alternatively, each guide 44 may be provided integrally with the duct member 40 or separately from the duct member 40.

In a case in which each of the plurality of heating parts 12 has a different load, it is possible to allow a volume of the airflow, which is discharged from the outlet 13 close to the heating part 12 having a large load among the plurality of heating parts 12, to be greater than a volume of the airflow, which is discharged from the outlet 13 close to the heating part 12 having a small load or the heating part 12 that is not operated among the plurality of heating parts 12. For example, in a case in which only the heating part 12, which is placed in the left side with respect to the user's side shown in FIG. 1, is operated, it is possible to allow the volume discharged from the left outlet 13 to be greater than the volume discharged from the right outlet 13. Accordingly, it is possible to obtain a sufficient flow velocity in a position where a lot of smoke is generated, and thus it is possible to guide the smoke to the ventilation device V. At the same time, it is not required to increase a torque of the fan 30 corresponding to the blowing means, more than necessary and thus it is possible to minimize the noise and the power consumption. Further, it is possible to increase the volume discharged from the outlet 13 as the load of the heating part 12 is increased. Accordingly, it is possible to guide smoke to the ventilation device V by the sufficient flow velocity even when the large amount of smoke is generated. The blowing control may be performed by changing the torque of the fan 30 or by adjusting an opening degree of a damper provided in the duct member 40.

Referring to FIGS. 2 and 3, the heating cooker according to the embodiment further includes a debris tank 50 provided below the duct member 40.

The debris tank 50 is provided below the main flow path member 42, and the debris tank 50 is arranged to allow foreign substances, which are introduced through the outlet 13, to fall thereon without flowing back to the sub flow path member 41.

More particularly, the main flow path member 42 extends further down than the sub flow path member 41, and a lower end of the main flow path member 42 is connected to the debris tank 50. In addition, in a portion in which the sub flow path member 41 is connected to the main flow path member 42, a lower end portion 41*b* on an inner circumferential surface forming the sub flow path member 41 is provided on the fan 30 side than an upper end portion 41*a* on the inner circumferential surface or provided just below the upper end portion.

Therefore, even if moisture or foreign substances are introduced through the outlet 13, the foreign substances may be collected in the debris tank 50 without reaching the fan 30.

In addition, because the debris tank 50 is configured to be detachable from the duct member 40, the foreign substances collected in the debris tank 50 may be easily taken out, thereby providing improved maintenance.

As for the heating cooker 100 configured as described above, the outlet 13 is formed on the left and right sides of the heating part 12, and further, because the airflow discharged from the outlet 13 is directed from the front to the rear, it is possible to effectively guide smoke to the ventilation device V during the cooking.

Therefore, it is possible to guide smoke during cooking to the ventilation device V without increasing noise and vibration of the ventilation device V and further without causing an increase in cost and size of the cooker.

Figure 6:
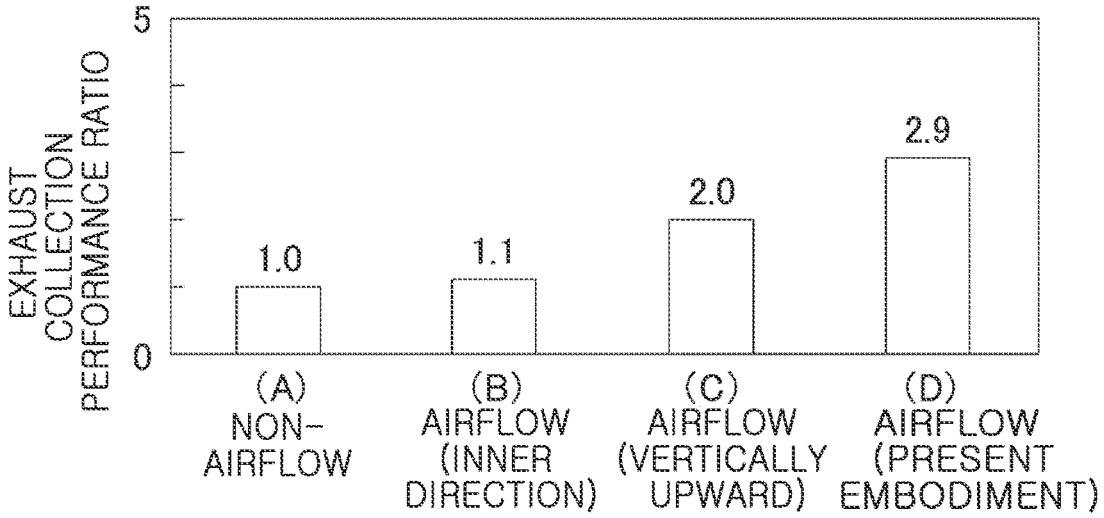
FIG. 6 is a graph comparing a performance of a built-in heating cooker according to the first embodiment of the disclosure and a performance according to the related art.

FIG. 6, is a graph comparing a performance of a build-in heating cooker according to an embodiment of the disclosure and a performance according to the related art.

Referring to FIG. 6, as can be seen from this graph, the configuration of the disclosure that is a case D in which the airflow is discharged at an angle from the front side to the rear side when viewed from the front side of the range has a relatively high exhaust collection performance, in comparison with a case A in which there is no airflow discharged from the outlet, a case B in which the airflow is discharged at an angle from the outside to the center when viewed from the front side of the range, and a case C in which the airflow is discharged vertically upward from the outlet without an inclination.

In addition, because the fan 30 corresponding to the outlet 13 is provided on the left and right sides of the oven, each fan 30 may be small and thus the fan 30 may be arranged in a limited space on both sides of the oven.

Further, because the guide 44 is installed at one or more positions in the inside of the duct member 40 to reduce a deflection of the airflow, it is possible to suppress the flow separation in the duct member 40 and to achieve equalization of the airflow distribution. Therefore, it is possible to more effectively generate the airflow for guiding the smoke to the ventilation device V.

Further, as shown in FIG. 4, the relationship among the angle θ1, which is formed by the vertical direction and the flow path direction of the front flow path La, the distance X along the front and rear direction from the front end of the outlet 13 to the front end of the inlet V1 of the ventilation device V, and the height Y along the vertical direction from the outlet 13 to the inlet V1 satisfies $\theta 1 \geq \tan^{-1}(X/Y)$, and thus it is possible to reliably guide smoke generated in the font portion of the range body 10 to the ventilation device V.

In addition, because, with respect to the front and rear direction, the airflow discharged from the front flow path La is more inclined than the airflow discharged from the rear flow path Lb, it is possible to reliably guide the smoke generated in the font portion of the range body 10 to the ventilation device V. Further, because the airflow discharged from the rear flow path Lb is more vertically upward than the airflow discharged from the front flow path La, it is possible to form an appropriate airflow toward the ventilation device V without guiding the smoke to the rear side more than necessary. Therefore, it is possible to improve the smoke collection efficiency.

Further, because the fan 30 is provided below the inner space of the oven, it is possible to secure a sufficient distance from the outlet 13 to the fan 30. Therefore, branching of the airflow generated in the fan 30 or rectification of the airflow is possible and further it is possible to prevent short circuit (re-suction) of the airflow.

The disclosure is not limited to the above embodiment.

Figure 7:
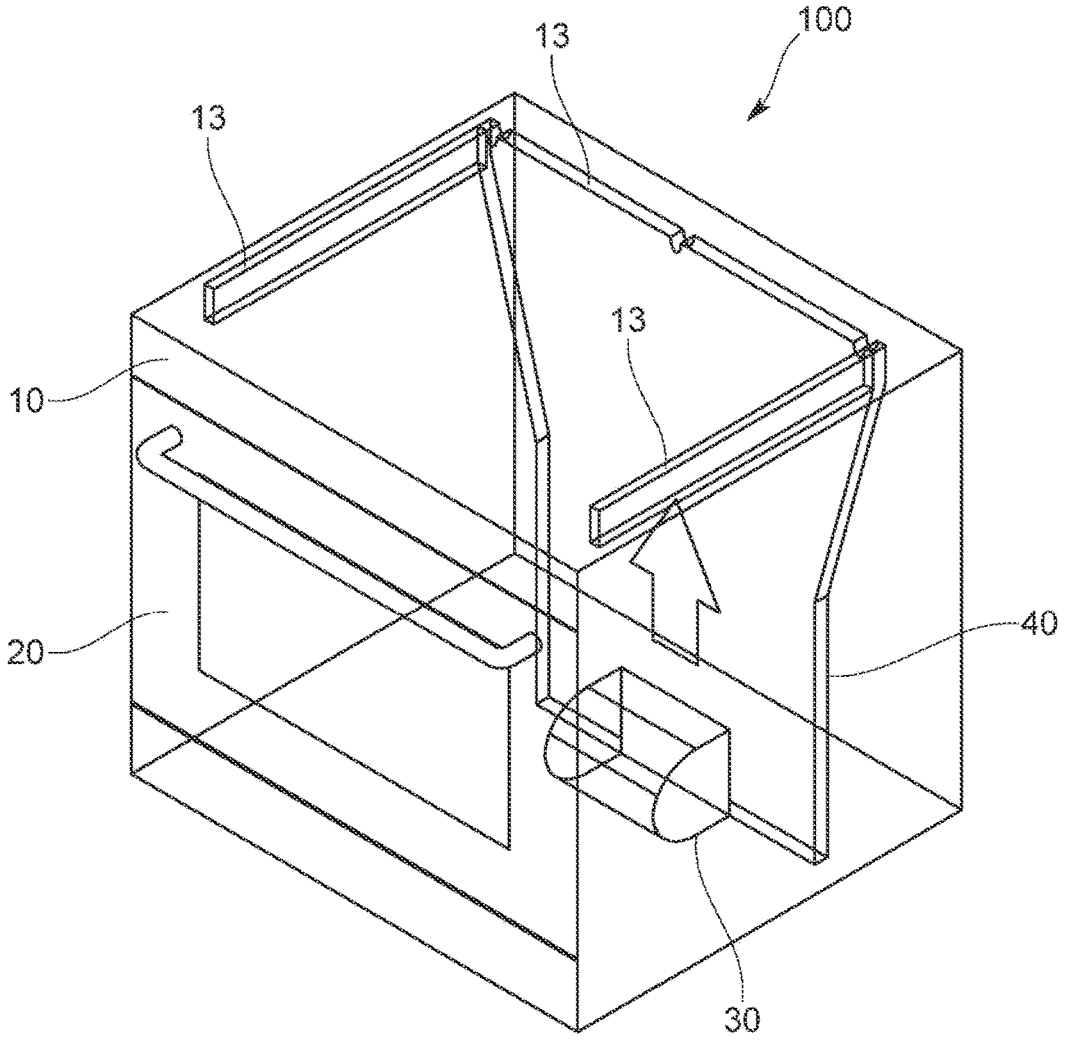
FIG. 7 is a schematic view illustrating an internal configuration of a built-in heating cooker according to the first embodiment of the disclosure.

FIG. 7 is a schematic view illustrating an internal configuration of a built-in heating cooker according to an embodiment of the disclosure.

Referring to FIG. 7, the outlet 13 is provided on the left and right sides of the upper surface 11 of the range body 10 according to an embodiment of the disclosure, but the outlet 13 may be provided behind the upper surface 11, as shown in FIG. 7.

In addition, the fan 30 may not be installed in correspondence with the outlet 13, and thus the airflow from a common fan 30 may be guided to the outlet 13 on the left and right sides, as shown in FIG. 7.

In addition, an example in which the plurality of branched flow paths L is divided into the front flow path La and the rear flow path Lb has been described in an embodiment of the disclosure, but the plurality of branched flow path L may be divided into three or more flow paths having different discharge directions, such as a front flow path La, a central flow path, and a rear flow path Lb.

Further, the flow path direction of the branched flow path L may be set to be directed to the center from the left and right outer sides.

More particularly, by setting the flow path direction of the rear flow path Lb as from the left and right outer to the center, the distribution of the airflow formed at the rear is shifted to the center, and thus it is possible to form an airflow that is effective for a ventilation device V having a narrow inlet V1 in the left and right direction.

Hereinafter a built-in heating cooker according to a second embodiment of the disclosure will be described with reference to the drawings.

Figure 8:
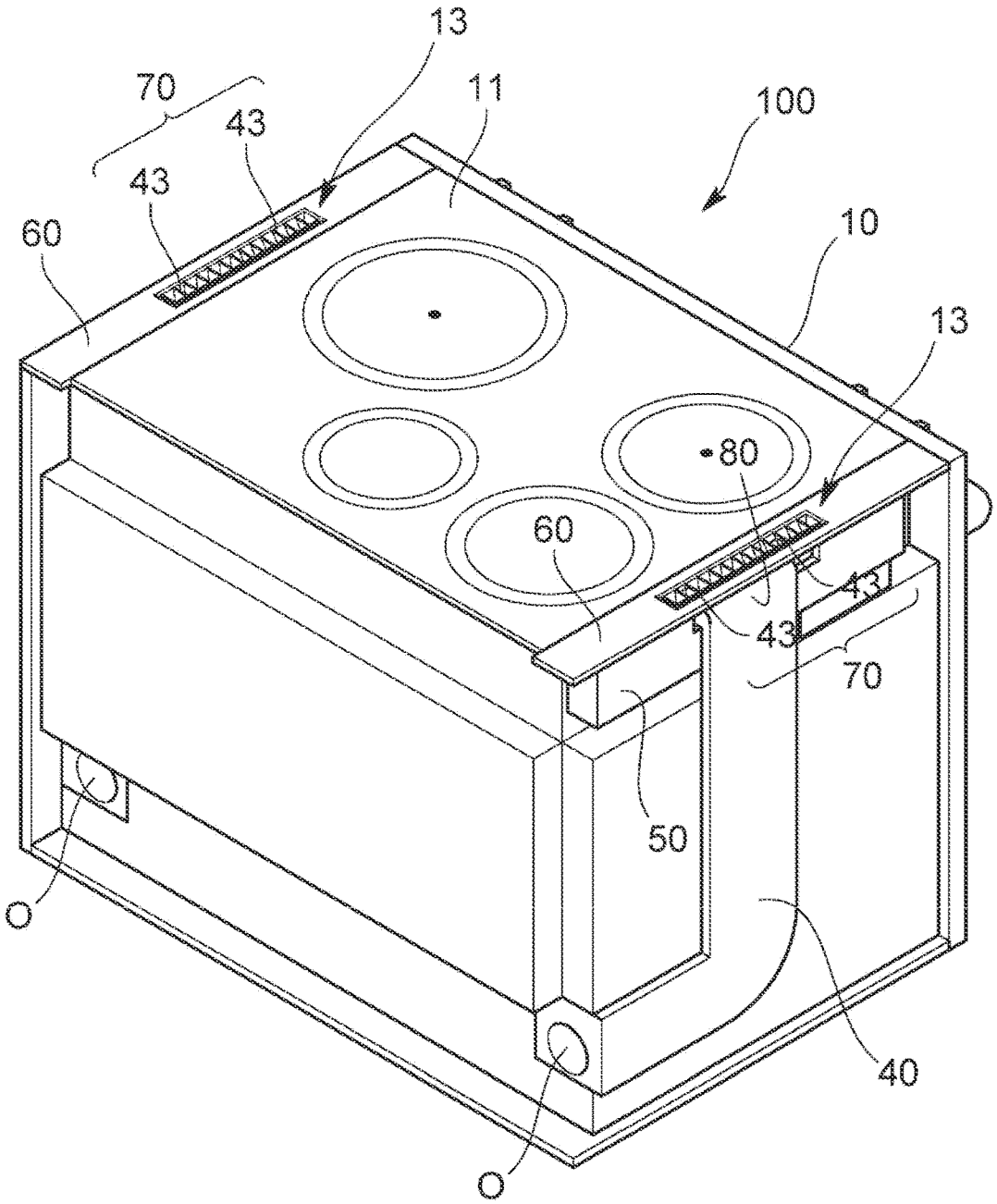
FIG. 8 is a schematic view illustrating an overall configuration of a built-in heating cooker according to a second embodiment of the disclosure.

FIG. 8 is a schematic view illustrating an overall configuration of a built-in heating cooker according to an embodiment of the disclosure.

Figure 9:
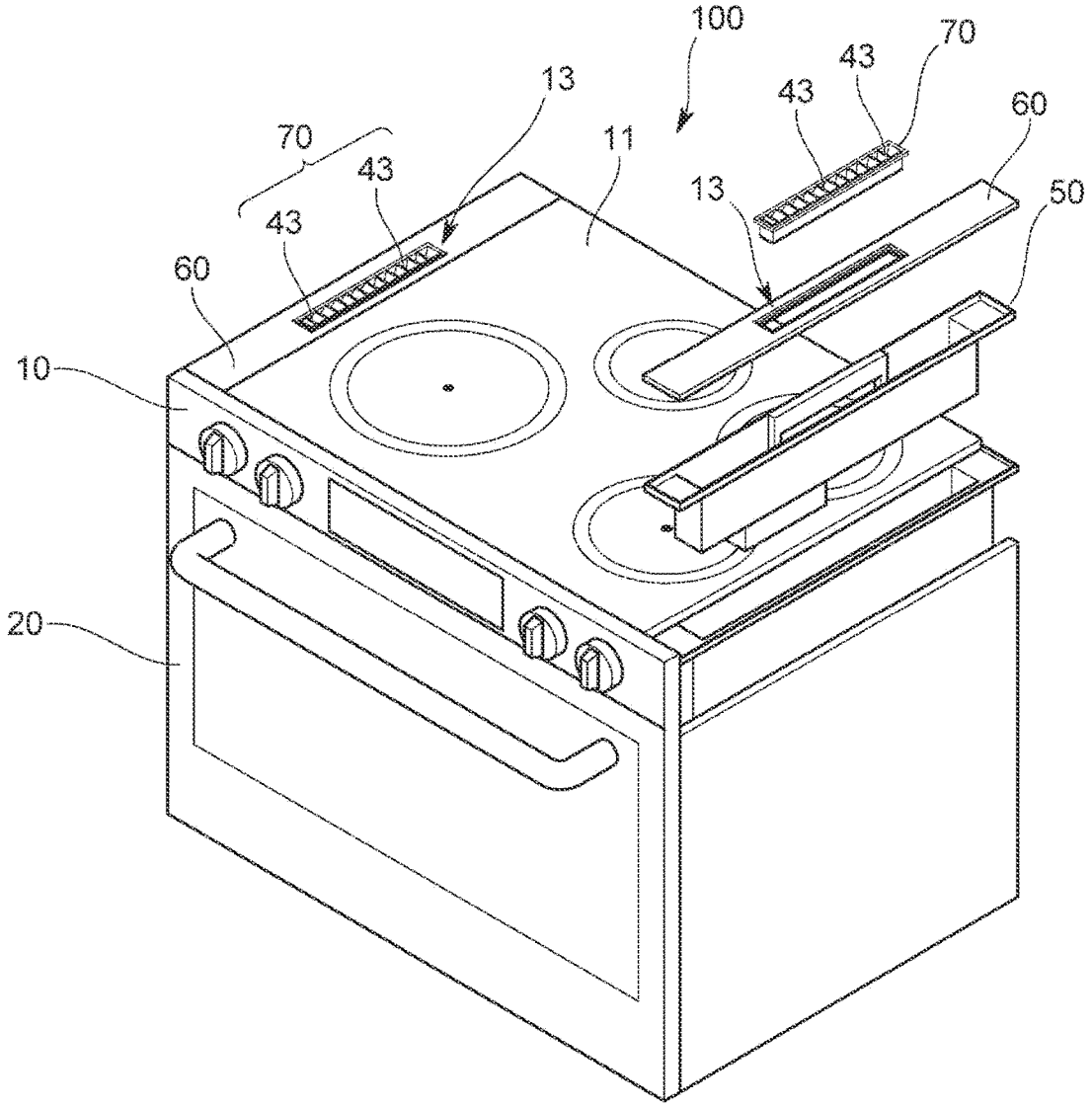
FIG. 9 is a schematic view illustrating an overall configuration of a built-in heating cooker according to the second embodiment of the disclosure.

FIG. 9 is a schematic view illustrating an overall configuration of a built-in heating cooker according to an embodiment of the disclosure.

Figure 10:
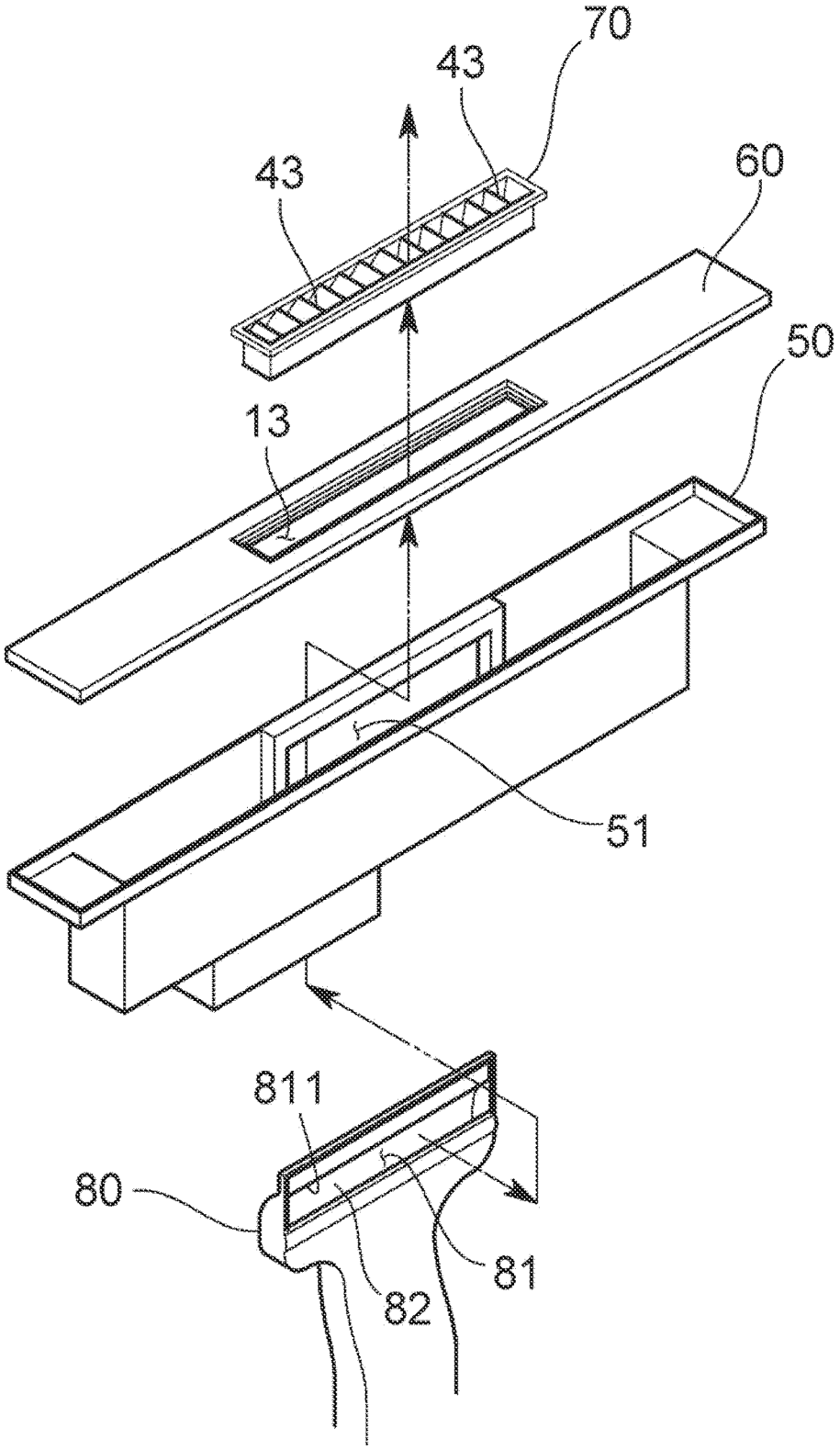
FIG. 10 is a perspective view illustrating a state in which a debris tank is separated according to the second embodiment of the disclosure.

FIG. 10 is a perspective view illustrating a state in which a debris tank is separated according to an embodiment of the disclosure.

Figure 11:
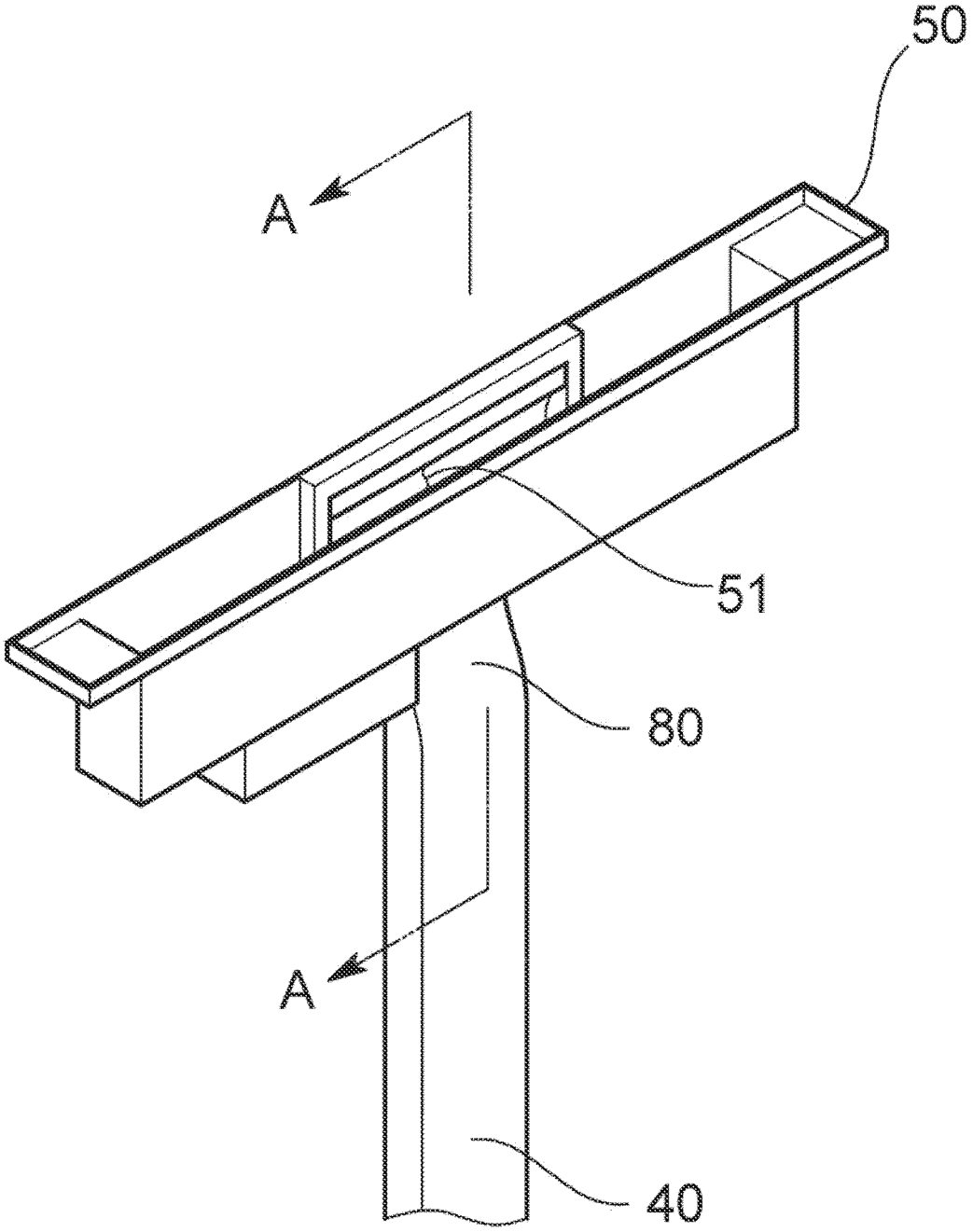
FIG. 11 is a perspective view illustrating a state in which a debris tank is assembled according to the second embodiment of the disclosure.

FIG. 11 is a perspective view illustrating a state in which a debris tank is assembled according to an embodiment of the disclosure.

Referring to FIGS. 8, 9, 10, and 11, according to an embodiment of the disclosure, the built-in heating cooker 100 further includes a debris tank 50 provided below an outlet 13 to collect foreign substances falling from the outlet 13. According to an embodiment of the disclosure, the debris tank 50 is provided below each of the left and right outlets 13.

The debris tank 50 is coupled to a groove formed on an upper surface 11, and the debris tank 50 has a box shape with an open upper surface as shown in FIGS. 9 to 11. The outlet 13 is formed in a rod shape extending from the front to the rear of the upper surface 11, and the debris tank 50 is formed in a rod shape extending from the front to the rear of the outlet 13. Accordingly, a longitudinal length of the debris tank 50 is set to be greater than a longitudinal length of the outlet 13. A water level sensor (not shown) configured to detect a level of liquid debris stored in the debris tank 50 may be provided in the debris tank 50.

According to an embodiment of the disclosure, the built-in heating cooker 100 further includes a lid member 60 configured to cover the opening of the debris tank 50 as shown in FIGS. 8, 9, and 10.

The lid member 60 has a flat plate shape in which the outlet 13 is formed, and the lid member 60 may be formed of a nonmagnetic material. The lid member 60 is provided in such a way that an upper surface of the lid member 60 forms the same surface as the upper surface 11 in response to covering the opening of the debris tank 50 coupled to the groove of the upper surface 11. Accordingly, the outlet 13 also forms the same surface as the upper surface 11.

The outlet 13 has a rod shape extending from the front to the rear of the upper surface 11 as described above, and the plurality of louver 43 described in the first embodiment is disposed therein.

More particularly, according to an embodiment of the disclosure, an air blowing structure 70, in which a plurality of louvers 43 integrally provided, is coupled to the outlet 13, and the airflow discharged from the outlet 13 is directed from the front to the rear by the air blowing structure 70.

Referring to FIG. 10, the air blowing structure 70 includes a pair of side wall 71 extending in the longitudinal direction of the outlet 13, and the plurality of louvers 43 provided in such a way that opposite ends thereof are supported by the side walls 71 and the plurality of louver 43 is intermittently provided along the longitudinal direction between the side walls 71. The shape of the plurality of louver 43, such as an inclination angle is the same as the shape of the plurality of louver 43 of the first embodiment of the disclosure, and a detailed description will be omitted.

In the above-described configuration, the air blowing structure 70, the lid member 60, and the debris tank 50 are all detachable, and particularly, the air blowing structure 70, the lid member 60, and the debris tank 50 may be removed from the upper surface 11 upward.

Figure 12:
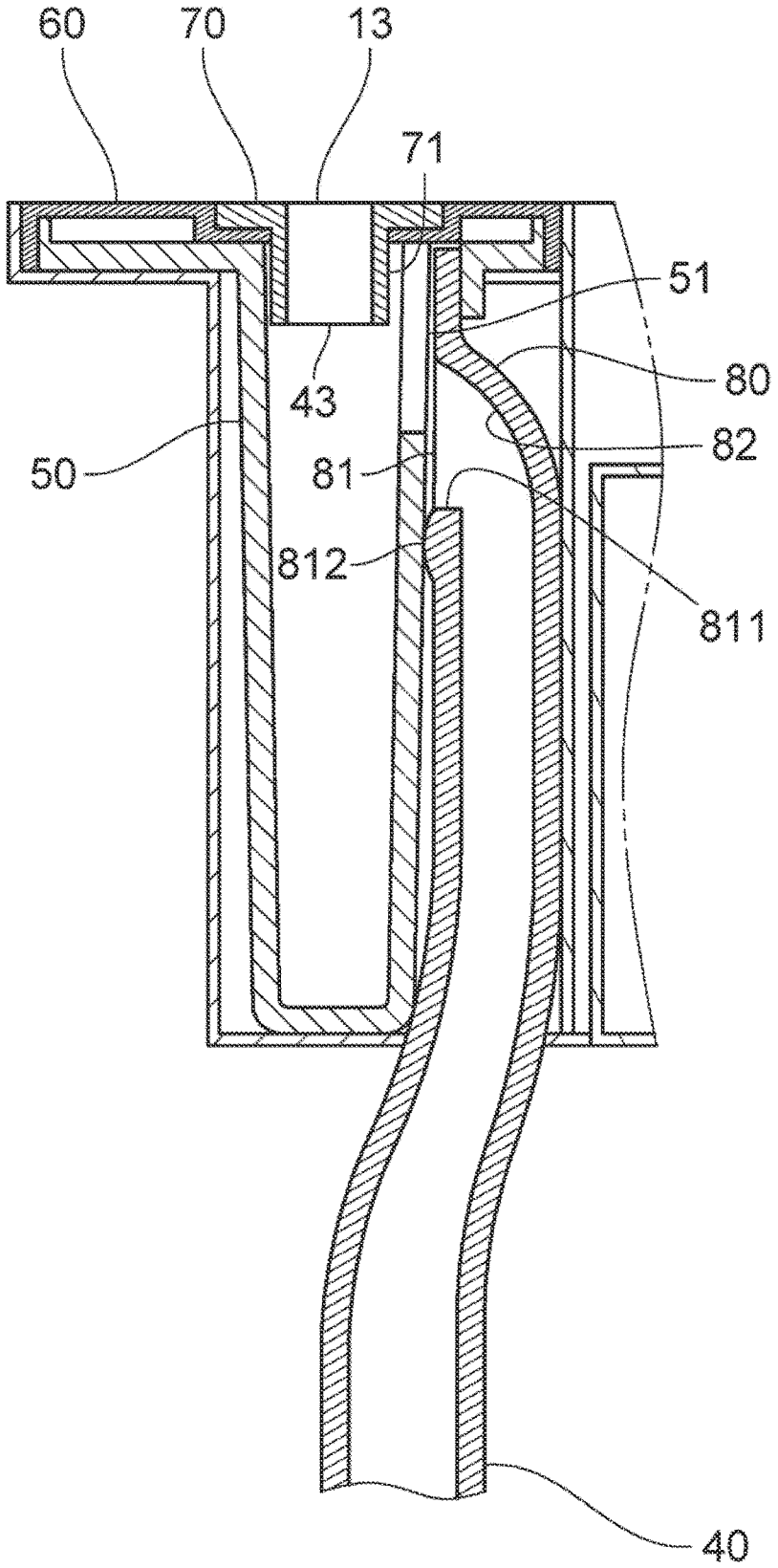
FIG. 12 is a sectional view taken along a line A-A illustrating an internal configuration of a debris tank and a nozzle member according to the second embodiment of the disclosure.

FIG. 12 is a sectional view taken along a line A-A illustrating an internal configuration of a debris tank and a nozzle member according to an embodiment of the disclosure.

Figure 13:
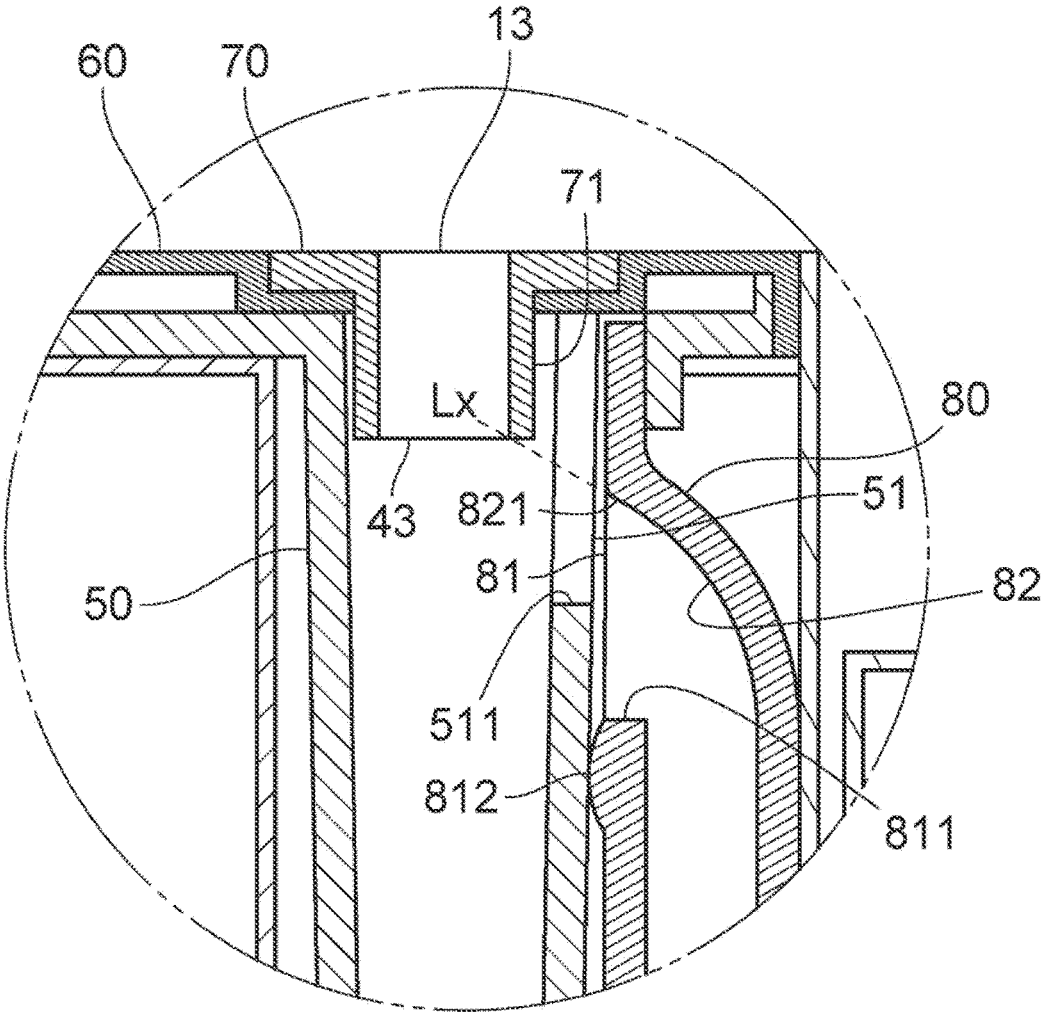
FIG. 13 is an enlarged-sectional view illustrating an internal configuration of a debris tank and a nozzle member according to the second embodiment of the disclosure.

FIG. 13 is an enlarged-sectional view illustrating an internal configuration of a debris tank and a nozzle member according to an embodiment of the disclosure.

Referring to FIGS. 12 and 13, a slit 51 is formed on the side wall of the debris tank 50, and a nozzle member 80 configured to communicate with the slit 51 and provided in such a way that an inner space of the nozzle member 80 forms a part of a flow path of an airflow moving toward the outlet 13 is provided.

The nozzle member 80 serves as the downstream end of the duct member 40 described in the first embodiment of the disclosure, and the airflow generated by the fan provided at the upstream end of the duct member 40 is guided and then discharged through a discharge port 81 corresponding to an opening in the downstream. The discharge port 81 of the nozzle member 80 extends from the front to the rear, and a longitudinal length of the discharge port 81 is set to be greater than a longitudinal length of the duct member 40.

Unlike the first embodiment of the disclosure, the fan is disposed on a lower rear side of the heating cooker 100. Therefore, in comparison with the case in which the fan is disposed on the lower front side, it is difficult to transmit rotation sound to a user, thereby reducing noise. In addition, as shown in FIG. 8, an inlet O of the fan is provided on an outer surface (particularly, a rear surface) of the heating cooker 100 so as to face the outside. Therefore, the inlet O suctions air in the room without suctioning air that is heated in the body of the oven or heat recovery air, and thus a self-cooling is performed in a fan motor. Therefore, it is possible to prevent an increase in the temperature, thereby driving the fan at an appropriate temperature.

Referring to FIGS. 11 and 12, the slit 51 is formed on the side wall of the debris tank 50 facing the inside, and the slit 51 and the discharge port 81 of the nozzle member 80 are arranged to face each other.

By the above mentioned configuration, air passing through the nozzle member 80 is introduced into the debris tank 50 through the slit 51 of the debris tank 50 from the discharge port 81, raised in the debris tank 50, passes through the plurality of louver 43 and then discharged from the outlet 13.

According to an embodiment of the disclosure, as shown in FIG. 10, the slit 51 of the debris tank 50 and the discharge port 81 of the nozzle member 80 are formed in such a way that the longitudinal direction of the slit 51 and the discharge port 81 are aligned with the front and rear direction, and a lower side portion 811 of the discharge port 81 is placed below a lower side portion 511 of the slit 51. As shown in FIG. 13, a protrusion 812 in contact with the side wall by protruding toward the side wall of the debris tank 50 is provided on the lower side portion 811 of the discharge port 81.

However, as described above, in response to placing the slit 51 formed on the side wall of the debris tank 50 to face the discharge port 81 of the nozzle member 80, the airflow, which flows from the lower side to the upper side in the inside of the duct member 40, is directed to the lateral side in the nozzle member 80, and pressure loss caused by the deflection of the airflow may occur.

Therefore, referring to FIG. 13, a region 82 of the inner surface of the nozzle member 80 facing the slit 51 of the debris tank 50 is curved to be close to the slit 51 as the region 82 goes upward, and thus the region 82 serves as a guide surface configured to allow an airflow discharged from the discharge port 81 of the nozzle member 80 to smoothly moved to the plurality of louver 43.

More particularly, an edge portion 821 on the most downstream side of the guide surface corresponds to an upper end portion of the discharge port 81, and on a virtual extension line Lx formed by extending the edge portion 821 toward a tangential direction, a lower end of the side wall 71 of the air blowing structure 70 is placed and at the same time, a lower end of the plurality of louver 43 is placed.

In the built-in heating cooker 100 configured as mentioned above, even if foreign substances, such as an object to be cooked or spills caused by overflowing, falls from the outlet 13, the foreign substances may be collected in the debris tank 50 and thus it is possible to prevent the foreign substances from being introduced to the inside of the nozzle member 80.

Further, because the discharge port 81 of the nozzle member 80 is disposed to face the slit 51 formed on the side wall of the debris tank 50, the foreign substances falling from the outlet 13 may fall down directly by gravity and thus it is possible to prevent the foreign substances from being introduced into the nozzle member 80.

Further, because the lower side portion 811 of the discharge port 81 is located below the lower side portion 511 of the slit 51, the air discharged from the nozzle member 80 may be smoothly delivered to the plurality of louver 43.

In addition, because the protrusion 812 is provided on the lower side portion 811 of the discharge port 81, a gap between the side wall of the debris tank 50 and the nozzle member 80 may be sealed by the protrusion 812, thereby preventing the foreign substances from being introduced through the gap.

Moreover, because the lower end of the air blowing structure 70 is located on the virtual extension line Lx formed by extending the edge portion 821 on the downstream side of the guide surface, the air flowing out of the nozzle member 80 may be smoothly delivered to the plurality of louver 43, thereby effectively guiding the smoke to the ventilation device during cooking.

Because a length of the debris tank 50 in the longitudinal direction is greater than a length of the outlet 13 in the longitudinal direction, a large volume of the debris tank 50 may be secured, and thus even if a large amount of the cooking object overflows, spills corresponding to foreign substances may be reliably stored in the debris tank 50.

Because the outlet 13 is formed on the same surface as the upper surface 11, it is not required to make foreign substances easily flow into the outlet 13, and further, the outlet 13 does not interfere with cooking.

The lid member 60 is non-magnetic, and thus the lid member 60 is not affected by heat of an induction heating (IH) range.

The debris tank 50 may be detachable upward from the upper surface 11. Therefore, it is not required to move the heating cooker 100 or it is not required for a user to take an uncomfortable position for separating the debris tank 50. Accordingly, it is possible to easily remove the foreign substance collected in the debris tank 50 and to wash the debris tank 50, thereby achieving ease of maintenance.

The disclosure is not limited to the second embodiment.

For example, according to the second embodiment of the disclosure, the lower end of the air blowing structure 70 is located on the virtual extension line Lx formed by extending the edge portion 821 on the most downstream side of the guide surface toward the tangential direction, but alternatively, the lower end of the air blowing structure 70 may be located above the virtual extension line Lx.

Although the nozzle member 80 is described as a part of the duct member 40 according to the second embodiment of the disclosure, the nozzle member 80 and the duct member 40 may be provided separately.

Further, in the above embodiment of the disclosure, the plurality of louvers 43 is provided integrally, but the plurality of louvers 43 may be separated from each other and independent of each other.

Figure 14:
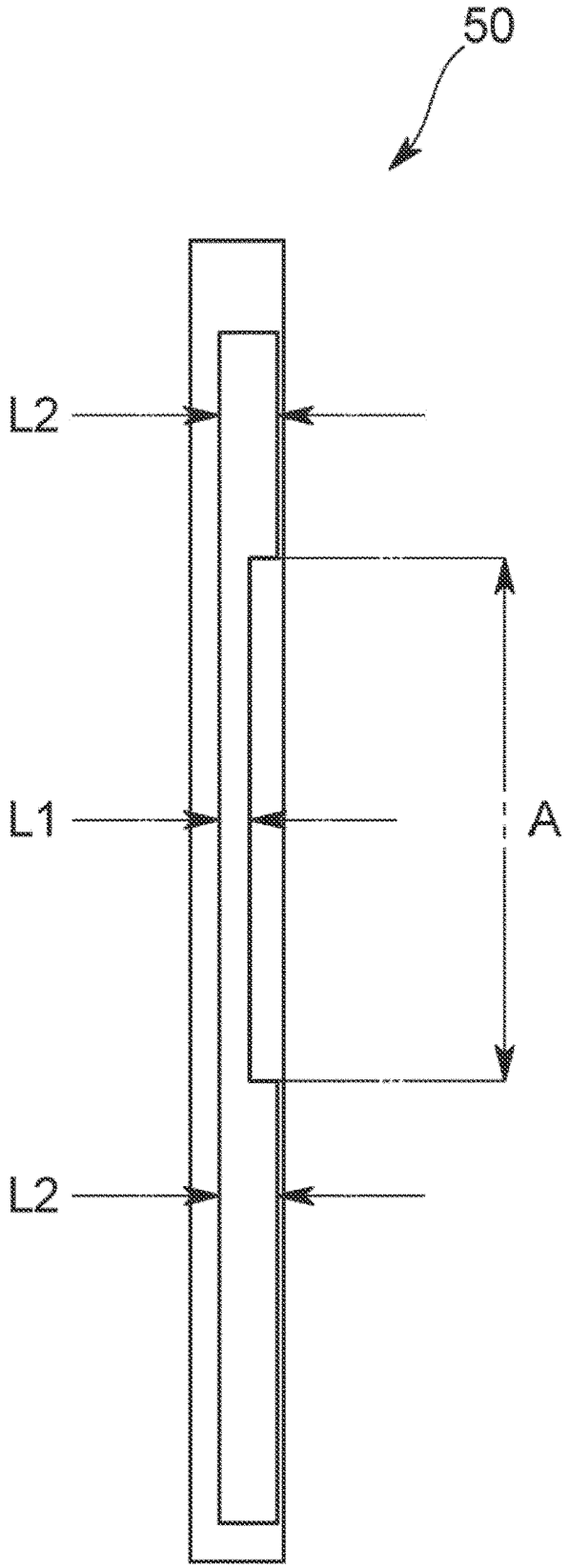
FIG. 14 is schematic view illustrating a configuration of a debris tank according to an embodiment of the disclosure.

FIG. 14 is schematic view illustrating a configuration of a debris tank according to an embodiment of the disclosure.

Referring to FIG. 14, in the debris tank 50, a predetermined region along the longitudinal direction of the side wall is set as a connection region A of the nozzle member 80, and a width L1 of an inner space in the connection region A may be less than a width L2 of an inner space in other regions.

In this case, it is possible to increase the inner space in the region other than the connection region A, and thus it is possible to form an internal volume of the debris tank 50 as large as possible.

As is apparent from the above description, it is possible to guide smoke to the ventilation device during cooking without increasing noise and vibration of the ventilation device and without causing an increase in cost and size of the cooker.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A cooking apparatus comprising:

a body;

a heating part disposed on an upper surface of the body and configured to heat an object to be heated;

an outlet part arranged on opposite sides of the heating part and configured to allow air to be discharged to an upper side of the body;

a tank disposed below the outlet part in an inside of the body and configured to communicate with the outlet part to collect foreign substances introduced through the outlet part;

a fan configured to generate an airflow discharged to the outlet part;

a duct configured to connect the fan to the outlet part; and an opening from the duct to the tank, the opening being above a bottom of the tank, wherein the outlet part comprises an outlet through which air is discharged, wherein a louver arranged on the outlet and configured to guide an airflow discharged from the outlet part to allow the airflow discharged from the outlet part to mix with an airflow generated by the heating part, thereby forming an ascending airflow directed from a front side to a rear side of the body, wherein the tank comprises a slit connected to the duct to allow the duct to communicate with the outlet part, and wherein the duct comprises a discharge port disposed to face the slit, and configured to discharge the airflow generated by the fan.

2. The cooking apparatus of claim 1, wherein the louver comprises a first louver disposed on a front portion of the outlet and a second louver disposed behind the first louver on the outlet, and wherein an inclination angle of the first louver is different from an inclination angle of the second louver.

3. The cooking apparatus of claim 2, wherein with respect to a front and rear direction of the body, the inclination angle of the first louver is greater than the inclination angle of the second louver.

4. The cooking apparatus of claim 3, wherein, when the inclination angle of the first louver is θ1, a distance in the front and rear direction of the body between a front end of an inlet of a ventilation device, which is disposed above the body and configured to suction the airflow generated by the heating part, and a front end of the outlet is X, and a distance in an upper and lower direction of the body between the inlet of the ventilation device and the outlet is Y, the inclination angle of the first louver θ1 is set to satisfy $\theta 1 \geq \tan^{-1}(X/Y)$.

5. The cooking apparatus of claim 1, wherein the fan is disposed at a rear portion of the body with respect to a front and rear direction of the body.

6. The cooking apparatus of claim 1, wherein the tank is disposed to be detachable from the body.

7. The cooking apparatus of claim 1, wherein a length of the tank in a front and rear direction of the body is greater than a length of the outlet in the front and rear direction of the body.

8. The cooking apparatus of claim 1, wherein the slit is disposed on a side wall of the tank.

9. The cooking apparatus of claim 8, wherein a lower side portion of the discharge port is positioned below a lower side portion of the slit with respect to an upper and lower direction of the body.

10. The cooking apparatus of claim 9, wherein the lower side portion of the discharge port comprises a protrusion protruding toward the side wall of the tank.

11. The cooking apparatus of claim 9, wherein the duct further comprises a curved portion connected to an upper side portion of the discharge port, in an inside of the duct, and wherein a lower end of the louver is disposed on a virtual extension line extending in a tangential direction at a contact point between the curved portion and the upper side portion, or the lower end of the louver is disposed above the virtual extension line.

12. The cooking apparatus of claim 1, wherein an upper end of the heating part and an upper end of the outlet part are disposed on a same surface.

13. A cooking apparatus comprising:

a body;

a heating part disposed on an upper surface of the body and configured to heat an object to be heated;

an outlet part arranged on opposite sides of the heating part and configured to allow air to be discharged to an upper side of the body;

a tank configured to collect foreign substances introduced through the outlet part, wherein the tank is disposed below the outlet part in an inside of the body, and configured to be detachable from the body;

a fan configured to generate an airflow discharged to the outlet part;

a duct configured to connect the fan to the outlet part; and an opening from the duct to the tank, a height of the opening being smaller than an inside height of the tank.

14. The cooking apparatus of claim 13, wherein the outlet part comprises an outlet through which air is discharged, and wherein a louver is arranged on the outlet and configured to guide an airflow discharged from the outlet part to allow the airflow discharged from the outlet part to mix with an airflow generated by the heating part, thereby forming an ascending airflow directed from a front side to a rear side of the body.

15. The cooking apparatus of claim 14, wherein the outlet part further comprises a cover on which the outlet is formed, the cover configured to cover the tank in an upper and lower direction of the body, and wherein the tank is disposed to be detachable from the body to the upper side of the body.

16. The cooking apparatus of claim 15, wherein an upper surface of the cover and the heating part are disposed on a same surface.

17. A cooking apparatus comprising:

a body;

a heating part disposed on an upper surface of the body and configured to heat an object to be heated;

an outlet part comprising an outlet arranged on opposite sides of the heating part and configured to allow air to be discharged to an upper side of the body;

a tank disposed below the outlet part in an inside of the body, and comprising an opening directed to the outlet so as to collect foreign substances introduced through the outlet;

a fan configured to generate an airflow discharged to the outlet part; and a duct configured to communicate with the tank to connect the fan to the outlet part through the tank, wherein the tank comprises a slit connected to the duct to allow the duct to communicate with the outlet part, and wherein the slit is disposed on a side wall of the tank forming the opening.

* * * * *